US005766058A

United States Patent [19]

Lee et al.

[11] Patent Number: 5,766,058

[45] Date of Patent: Jun. 16, 1998

[54] CHEMICAL-MECHANICAL POLISHING USING CURVED CARRIERS

[75] Inventors: Dawn M. Lee, Fremont; Subramanian Venkatkrishnan, Los Altos, both of Calif.

[73] Assignee: Advanced Micro Devices, Inc., Sunnyvale, Calif.

[21] Appl. No.: 784,619

[22] Filed: Jan. 21, 1997

Related U.S. Application Data

[63] Continuation of Ser. No. 387,424, Feb. 10, 1995, abandoned.

[51] Int. Cl.[6] ..... B24B 7/00

[52] U.S. Cl. ..... 451/41; 451/285; 451/287; 451/289; 451/388; 451/398

[58] Field of Search ..... 451/41, 283, 285, 451/287, 289, 388, 397, 398

[56] References Cited

U.S. PATENT DOCUMENTS

| | | | |
|---|---|---|---|
| 3,841,031 | 10/1974 | Walsh | 451/41 |
| 3,888,053 | 6/1975 | White et al. . | |
| 3,911,562 | 10/1975 | Youmans | 29/590 |
| 4,009,539 | 3/1977 | Day . | |
| 4,193,226 | 3/1980 | Gill, Jr. et al. | 451/276 |
| 4,508,161 | 4/1985 | Holden | 451/388 |
| 4,724,222 | 2/1988 | Feldman | 451/388 |
| 4,811,522 | 3/1989 | Gill, Jr. | 451/285 |
| 4,944,836 | 7/1990 | Beyer et al. | 156/645 |
| 5,036,630 | 8/1991 | Kaanta et al. | 451/41 |
| 5,069,002 | 12/1991 | Sandhu et al. | 451/41 |
| 5,131,968 | 7/1992 | Wells et al. . | |
| 5,216,943 | 6/1993 | Breivogel et al. | 451/285 |
| 5,245,794 | 9/1993 | Salugsugan | 451/8 |
| 5,291,692 | 3/1994 | Takahashi et al. | 451/388 |
| 5,302,233 | 4/1994 | Kim et al. | 451/41 |
| 5,421,769 | 6/1995 | Schultz et al. | 451/41 |
| 5,423,716 | 6/1995 | Strasbaugh | 451/287 |
| 5,476,414 | 12/1995 | Hirose et al. | 451/41 |

FOREIGN PATENT DOCUMENTS

| | | | |
|---|---|---|---|
| 0 451 471A2 | 10/1991 | European Pat. Off. . | |
| 0 599 299A1 | 6/1994 | European Pat. Off. . | |
| 63-232953 | 9/1988 | Japan | 451/41 |

OTHER PUBLICATIONS

Kaufman et al. in "Chemical–Mechanical Polishing for Fabricating Patterned W Metal Features as Chip Interconnects," J. Electrochem. Soc., vol. 138, No. 11, Nov. 1991, pp. 3460–3464.

Ali et al., "Chemical–mechanical polishing of interlayer dielectric: A review," Solid–State Technology, Oct. 1994, pp. 63–68.

"Applied Optics" by Levi, John Wiley & Sons, 1968, pp. 424–425 Product Brochures and Chart by Rodel, Jun. and Dec., 1994.

*Primary Examiner*—Eileen P. Morgan

[57] ABSTRACT

Uniform planarization of a patterned semiconductor wafer is effected with a chemical-mechanical polishing apparatus containing a base plate comprising a convex surface portion.

20 Claims, 5 Drawing Sheets

CHEMICAL-MECHANICAL POLISHING USING CURVED CARRIERS

This application is a continuation of application Ser. No. 08/387,424 filed Feb. 10, 1995 now abandoned.

TECHNICAL FIELD

The present invention relates a method and apparatus for chemical-mechanical polishing to effect uniform planarization of a patterned semiconductor wafer. The invention has particular application in uniformly planarizing thin films of materials.

BACKGROUND ART

Semiconductor integrated circuits are manufactured by forming an array of separate dies on a common semiconductor wafer. During processing, the wafer is treated to form specified regions of insulating, conductive and semiconductor type materials. The ever increasing requirements for high density devices comprising wiring patterns with increasingly smaller distances between conductive lines poses a significant technological challenge. Conventionally, a wiring pattern comprising a dense array of conductive lines is formed by depositing a metal layer and etching to form a conductive pattern. A dielectric is then applied to the wiring pattern and planarization is effected as by chemical-mechanical polishing. However, it is extremely difficult to obtain uniformly planarized layers, particularly with dense arrays of conductive lines separated by small distances, such as less than one micron.

As shown in FIG. 1A, during an initial processing stage for forming an integrated circuit, a dielectric film 10 is deposited over a patterned conductive layer, such as a metal 11. The object is to planarize steps 12 in dielectric layer 10, as shown in FIG. 1B. After deposition of layer 10, the portion thereof outside the trench must be removed. Such removal can be effected by plasma etching, or by a simplified faster and relatively inexpensive method known as chemical-mechanical planarization or polishing (CMP).

CMP is a conventional technique as disclosed in, for example, Salugsugan, U.S. Pat. No. 5,245,794; Beyer et al., U.S. Pat. No. 4,944,836; Youmans, U.S. Pat. No. 3,911,562. CMP is discussed in relation to earlier methods of fabricating metal interconnect structures by Kaufman et al. in "Chemical-Mechanical Polishing for Fabricating Patterned W Metal Features as Chip Interconnects," J. Electrochem. Soc., Vol. 138, No. 11, November 1991, pp. 3460–3464. U.S. Pat. Nos. 4,193,226 and 4,811,522 to Gill, Jr. and U.S. Pat. No. 3,841,031 to Walsh relate to CMP apparatus.

Basically, in employing a conventional CMP apparatus, wafers to be polished are mounted on a carrier assembly which is placed on the CMP apparatus. A polishing pad is adapted to engage the wafers carried by the carrier assembly. A chemical agent containing an abrasive, typically a slurry, is dripped onto the pad continuously during the polishing operation while pressure is applied to the wafer via the carrier assembly.

A typical CMP apparatus 100 is shown in FIG. 2 and comprises a rotatable polishing platen 102, polishing pad 104 mounted on platen 102, driven by microprocessor control motor (not shown) to spin at about 10 to about 100 RPM. Wafer 106 is mounted on the bottom of a rotatable carrier assembly 108 so that a major surface of wafer 106 to be polished is positionable to contact the underlying polishing pad 104. Wafer 106 and carrier assembly 108 are attached to a vertical spindle 110 which is rotatably mounted in a lateral robotic arm 112 which rotates the carrier assembly 108 at about 10 to about 75 RPM in the same direction as platen 102 and radially positions the carrier assembly on the platen. Robotic arm 112 also vertically positions carrier assembly 108 to bring wafer 106 into contact with polishing pad 104 and maintain an appropriate polishing contact pressure. A tube 114 opposite carrier assembly 108 above polishing pad 104 dispenses and evenly saturates the pad with an appropriate cleaning agent 116, typically a slurry.

The carrier assembly normally employed in a CMP apparatus, such as that depicted in FIG. 2, is shown in FIG. 3 and typically comprises a base plate 30, to which a carrier film 32 is affixed, and a retaining ring 34. Patterned semiconductor wafer 33 is positioned against the carrier film 32 and a downward pressure is applied in the direction of the arrow 35. The base plate 30 is typically made of metal, such as stainless steel, while the retaining ring 34 is typically made of plastic and is mounted to the base plate 30 with screws (not shown). Conventionally, the base plate is provided with passages (not shown) through which a vacuum is applied to enable manipulation and transport of the patterned wafer to and from the polishing pad.

It is difficult to obtain a uniformly planarized surface employing conventional CMP techniques and apparatus, particularly of a high density conductive pattern with spacings filled with a dielectric material. For example, as shown in FIG. 5, conventional CMP of a patterned wafer 50 having metal pattern 51 and dielectric 52 undesirably results in deviations 53 from a desirable uniform planarization 54.

Upon initially installing a carrier film on a carrier apparatus of a CMP apparatus, a test wafer is conventionally evaluated for polishing rate and surface uniformity. Planarization by CMP is conducted with the carrier apparatus to process the wafer until the non-uniformity value exceeds the specification limit. A normal failure mode for non-uniformity is a wafer which is polished to a greater extent on the edges than in the center of the wafer. FIG. 4, illustrates a test wafer 40 planarized by CMP and evaluated by a conventional nine point program for thickness measurements. The points in the center of the wafer, e.g., points 1–5, have a higher post polishing thickness vis-à-vis the edge portions identified by points 6–9.

The problem of non-uniform planarization resulting from conventional CMP techniques and apparatus is recognized in the semiconductor industry. See Ali et al., "Chemical-mechanical polishing of interlayer dielectric: A review," Solid-State Technology, October 1994, pp. 63–68. Previous attempts to solve this problem focus upon improvements in the consumable materials employed during CMP, such as the polishing pad and cleaning agent, or improvements in the hardware itself, such as the CMP apparatus. These prior efforts, however, have proved less than satisfactory.

DISCLOSURE OF THE INVENTION

An object of the present invention is a CMP method for planarizing a surface on a patterned wafer, wherein the planarized surface exhibits improved uniformity.

Another object is a CMP apparatus for planarizing a surface on a patterned wafer, wherein the planarized surface exhibits improved uniformity.

Additional objects, advantages and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

According to the present invention, the foregoing and other objects are achieved in part by a carrier assembly for a CMP apparatus comprising a base plate having a convex surface portion.

Another aspect of the invention is a method of manufacturing a semiconductor device comprising planarizing a patterned wafer by CMP, which method comprises applying pressure to the patterned wafer by means of a carrier assembly comprising a base plate having a convex surface portion.

A further aspect of the present invention is an improvement in a conventional carrier assembly for a CMP apparatus containing a base plate, the improvement comprising a base plate having a convex surface portion.

Still another aspect of the present invention is an improvement in a conventional method of planarizing a patterned semiconductor wafer by CMP with a apparatus containing a carrier assembly having a base plate, the improvement comprising utilizing a base plate having a convex surface portion.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 5:
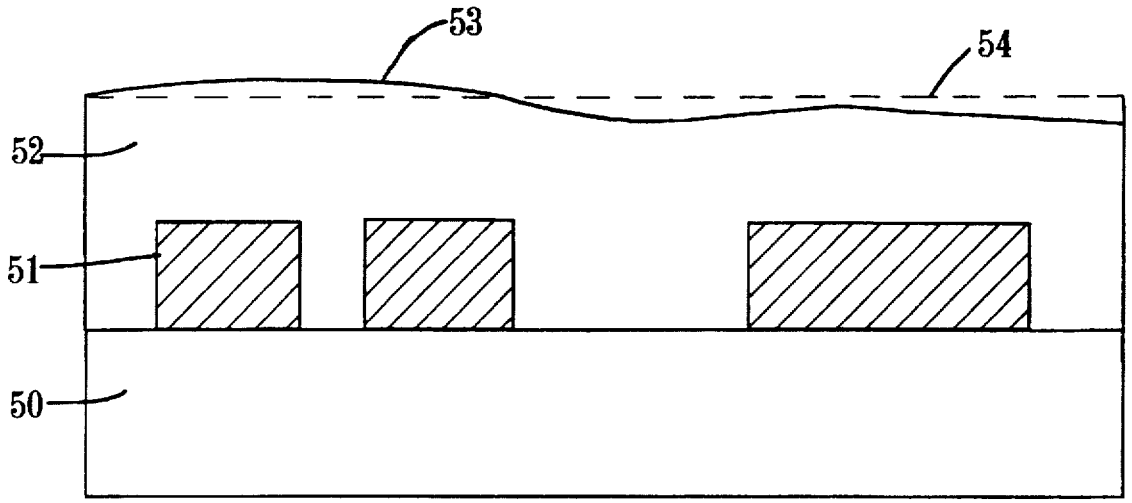
FIG. 5 schematically illustrates a non-uniform planarization problem addressed by the present invention.

The present invention addresses the problem of non-uniformly planarized surfaces upon employing conventional CMP techniques and apparatus, i.e., the resulting surface is characterized by deviations from uniform planarization as, for example, illustrated in FIG. 5 by deviations 53. A non-uniformly planarized surface of a patterned wafer adversely affects the reliability of the resulting semiconductor device, particularly a device comprising multi-level vias wherein the shallow vias would be overetched to insure complete etching at the deeper levels. In accordance with the present invention, the uniformity of surfaces of patterned semiconductor wafers planarized by CMP is markedly improved by modifying the base plate of a conventional carrier assembly to provide a convex portion surface.

Figure 6:
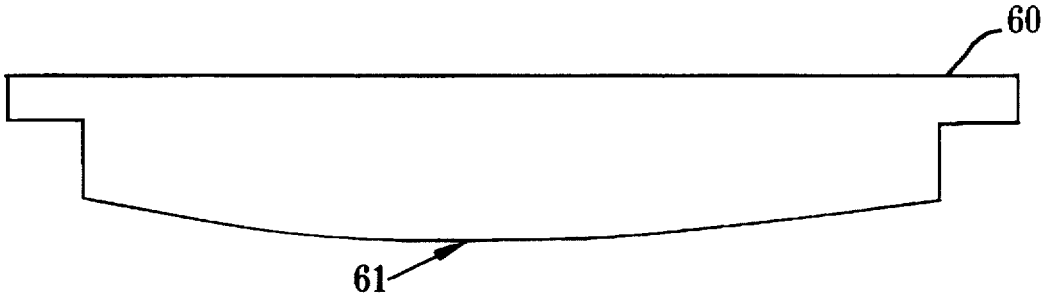
FIG. 6 is a cross-sectional view of a base plate of the present invention.

As shown in FIG. 6, the base plate 60 of the present invention is provided with a convex surface portion 61. In use, a carrier film (not shown) is affixed to the surface of the base plate having the convex surface portion 61, and a wafer positioned on the carrier film. A retaining ring and vacuum passages are preferably provided, as known in the art.

Figure 1A:
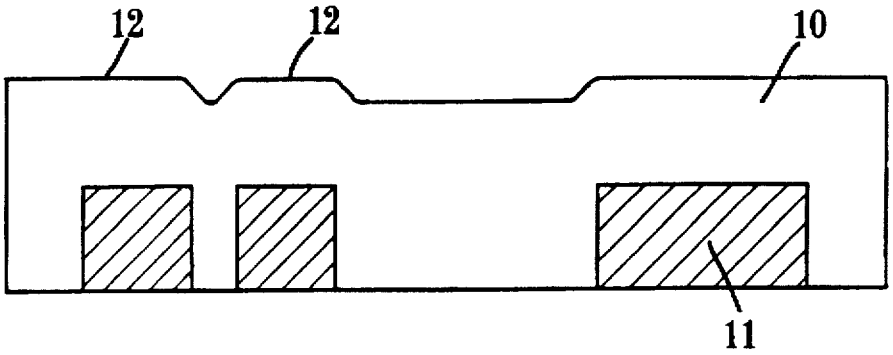
FIG. 1A schematically illustrates a covered pattern prior to planarization.
Figure 1B:
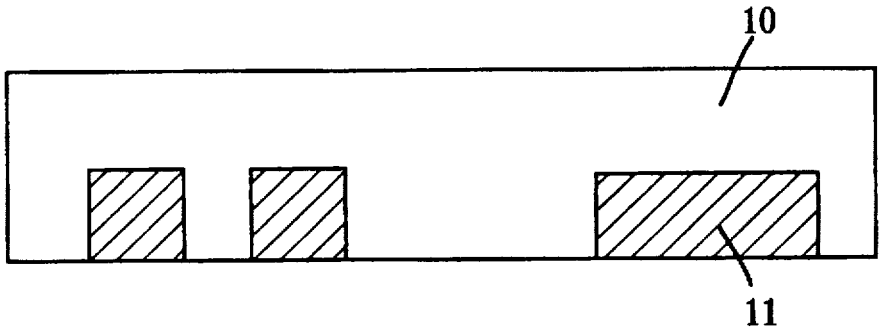
FIG. 1B schematically illustrates a planarized pattern.
Figure 2:
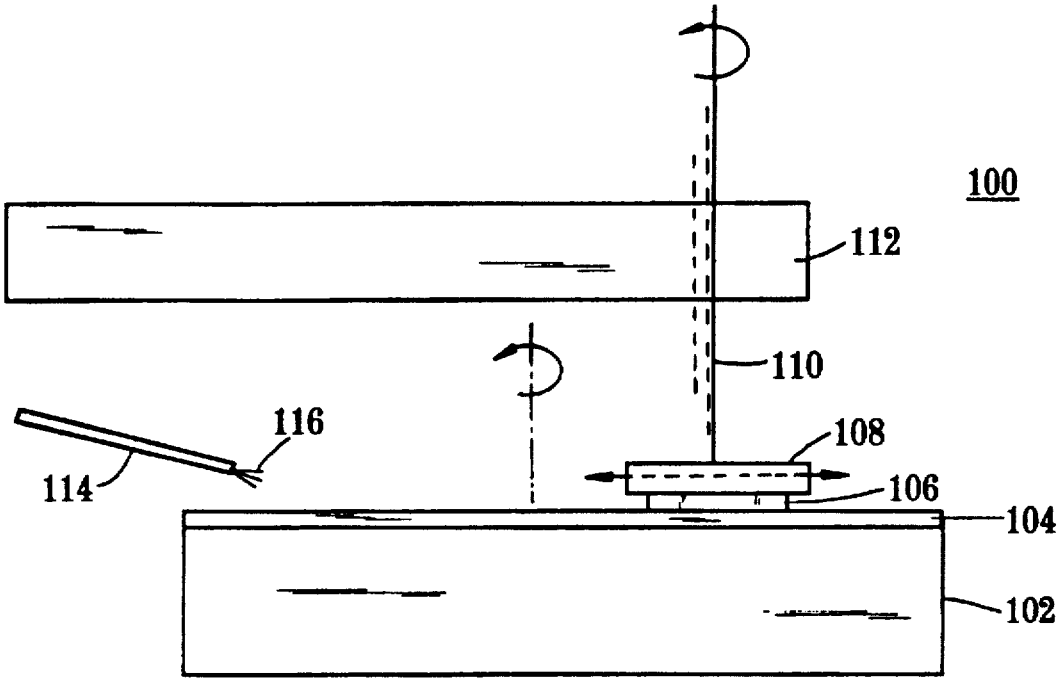
Figure 2 PRIOR ART
FIG. 2 schematically illustrates a typical CMP machine.
Figure 3:
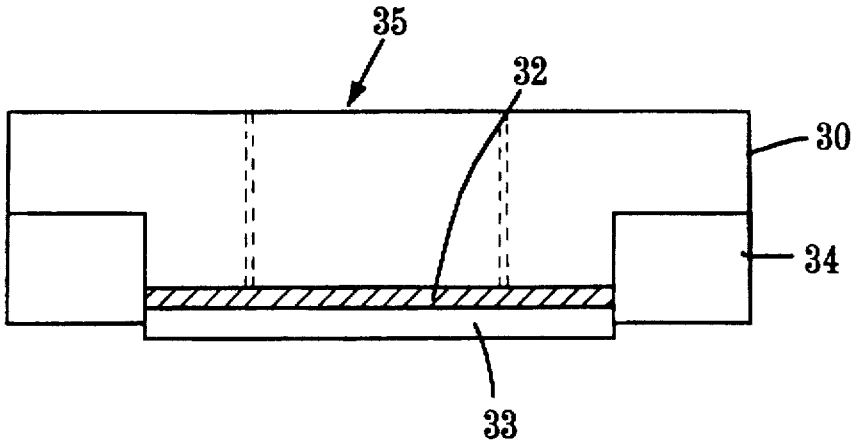
Figure 3 PRIOR ART
FIG. 3 depicts a conventional carrier assembly.
Figure 4:
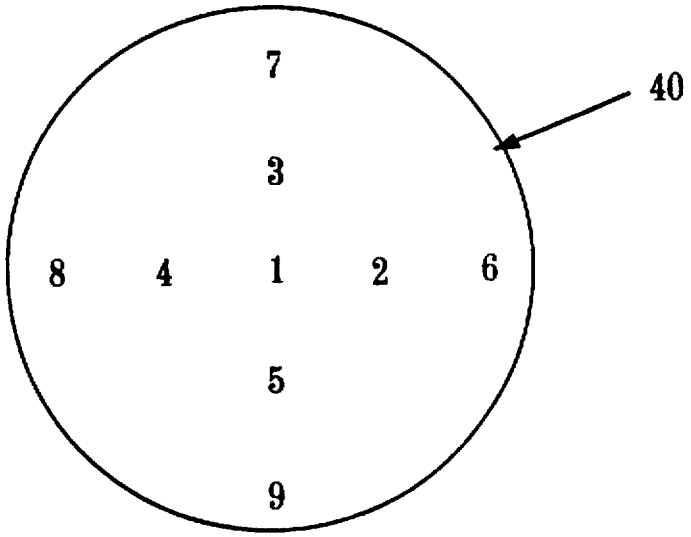
FIG. 4 represents a wafer test pattern illustrating a non-uniform planarization problem addressed by the invention.

When employing the base plate of the present invention, as shown in FIG. 6, the convex portion 61 protrudes so that, during CMP polishing, the center portion of the patterned wafer is polished at a faster rate vis-à-vis the edge portions of the wafer, thereby avoiding non-uniform planarization which would otherwise occur, as shown in FIG. 5, employing a conventional base plate having an essentially flat surface to which the carrier film is affixed as depicted in FIG. 3.

The carrier assembly of the present invention comprises a base plate having a convex surface portion made of metal, preferably stainless steel. The carrier assembly of the present invention preferably comprises a retaining ring, preferably made of plastic, which is affixed to the base plate by means of screws in a conventional manner. In accordance with the present invention, vacuum passages are provided in the base plate as well as carrier film to facilitate manipulation of the wafer, as by facilitating transport of the wafer to and from the polishing pad of the CMP apparatus.

In accordance with the present invention, the curvature of the convex surface portion of the base plate is optimized for a particular CMP situation. One having ordinary skill in the art would recognize that the optimum radius of curvature depends upon, inter alia, the nature and size of the particular patterned wafer undergoing CMP and the CMP apparatus and process parameters. It has been found that a curvature of the convex surface portion of the base plate having a sagitta of about 1 to about 25 microns, preferably a sagitta of about 5 to about 15 microns, employing a 5 inch spherometer, is suitable. The radius of curvature can be calculated from the sagitta and spherometer dimension using known mathematical relationships, as disclosed in "*Applied Optics*" by Levi, John Wiley & Sons, 1968, pp. 424–425.

The convex surface portion of the base plate of the present invention can be formed by modifying a conventional base plate using techniques, such as machining. Alternatively, the base plate of the present invention can be directly manufactured with a convex surface portion by conventional techniques.

The present invention comprising a base plate having a convex surface portion enables the planarization of surfaces of patterned semiconductor wafers by CMP with greatly improved uniformity. The present invention also advantageously extends the life of the carrier film without any adverse effect on the CMP removal rate or planarity. The carrier film exerts a major influence of surfaces planarized by CMP. The usual life of a carrier film employing a conventional base plate having an essentially flat surface is approximately 200–300 wafers. However, upon employing the base plate of the present invention having a convex surface portion, it was found that the life of a carrier film is extended to in excess of 500, and even in excess of 1000 wafers. This dramatic improvement in the life of a carrier film results in a significant decrease in equipment downtime and increases throughput considerably.

The present invention can be practiced employing otherwise conventional CMP techniques and, otherwise conventional CMP apparatus. For example, the CMP apparatus disclosed in the previously mentioned Gill, Jr. or Walsh patents can be employed in the practice of the present invention.

In practicing the present invention, an optimum initial pressure is selected to obtain effective removal of material at an economically desirable high rate of speed, typically between about 6 and about 10 psi. The polishing pad employed in the claimed invention can be any of those which are conventionally employed in CMP, such as those comprising a cellular polyurethane pad. The cleaning agent employed in the claimed invention can be any of those conventionally employed in CMP processing; preferably, the cleaning agent comprises a slurry. The carrier film employed in the present invention can be any of those commercially available. For example, DF200 and R200, available from Rodel, Newark, Del., are suitable.

Figure 7:
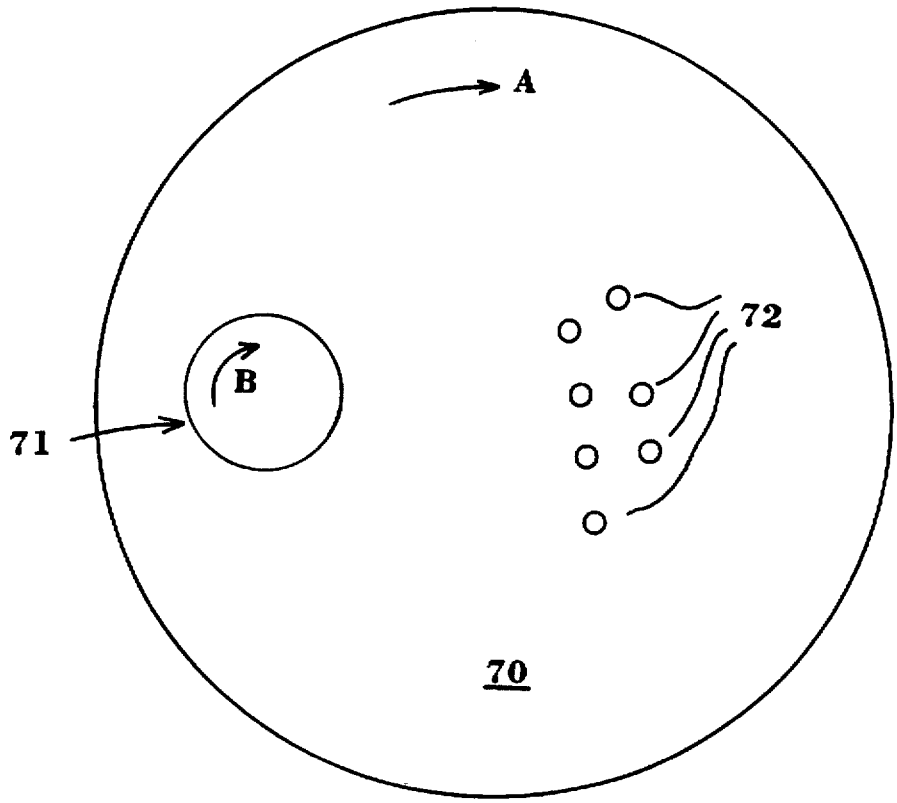
Figure 7 PRIOR ART
FIG. 7 illustrates conventional operation of a polishing pad.

As shown in FIG. 7, conventional methodology to which the claimed invention is applicable comprises rotating polishing pad 70 in the direction of arrow A, and applying pressure to carrier 71 which is rotating in the direction shown by arrow B. Typically, cleaning solution 72 is deposited on polishing pad 70 prior to and during CMP.

The inventive CMP apparatus and method are applicable to a wide variety of situations which require planarization during the course of manufacturing a semiconductor device. The improved CMP method and apparatus of the present invention greatly improves the uniformity of planarized patterned semiconductor wafers, advantageously reduces equipment downtime and production cost, while simplifying manufacturing and improving the reliability of the resulting semiconductor devices. The present invention enjoys utility in planarizing various types of surfaces on a patterned semiconductor wafer, including conductive and insulating materials, such as oxides, nitrides, polysilicon, single crystalline silicon, amorphous silicon, and mixtures thereof. The substrate of the patterned wafer containing the conductive or non-conductive material is generally a semiconductor material, such as silicon.

Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

We claim:

1. A carrier assembly for a chemical-mechanical polishing apparatus for planarizing a semiconductor wafer, which carrier assembly comprises a base plate having a convex surface portion with a radius of curvature, at room temperature, having a sagitta of about 1 to about 25 microns, measured using a 5 inch spherometer.

2. The carrier assembly according to claim 1, wherein the sagitta is about 5 to about 15 microns.

3. The carrier assembly according to claim 1, further comprising a carrier film affixed to a surface of the base plate having the convex surface portion.

4. The carrier assembly according to claim 1, further comprising a retaining ring.

5. The carrier assembly according to claim 1, wherein the base plate and carrier film comprise vacuum passages.

6. A chemical-mechanical polishing apparatus comprising the carrier assembly according to claim 1.

7. The chemical-mechanical polishing apparatus according to claim 5, further comprising a polishing pad.

8. The carrier assembly according to claim 1, wherein the base plate is manufactured to have the convex surface portion with a radius of curvature at room temperature.

9. The carrier assembly according to claim 1, wherein the base plate is machined to have the convex surface portion with the radius of curvature at room temperature.

10. A method of manufacturing a semiconductor device comprising planarizing a patterned wafer by chemical-mechanical polishing, which method comprises applying pressure to the patterned wafer by means of a carrier assembly comprising a base plate having a convex surface portion with a radius of curvature, at room temperature, having a sagitta of about 1 to about 25 microns, measured using a 5 inch spherometer.

11. The method according to claim 10, wherein the carrier assembly further comprises a carrier film affixed to a surface of the base plate having the convex surface portion, and wherein pressure is applied to the patterned wafer via the carrier film.

12. The method according to claim 10, wherein the sagitta is about 5 to about 15 microns.

13. The method according to claim 10, wherein the patterned wafer comprises a conductive pattern.

14. The method according to claim 10, comprising chemical-mechanical polishing the patterned wafer on a polishing pad.

15. The method according to claim 14, comprising applying a cleaning agent to a polishing pad during chemical-mechanical polishing.

16. The method according to claim 15, wherein the cleaning agent is a slurry.

17. The method according to claim 10, comprising manufacturing the base plate to have the convex surface portion with the radius of curvature, at room temperature, before planarizing the patterned wafer.

18. The method according to claim 10, comprising machining a base plate to have the convex surface portion with the radius of curvature, at room temperature, before planarizing the patterned water.

19. In a carrier assembly for a chemical-mechanical polishing apparatus containing a base plate, the improvement comprising a base plate having a convex surface portion with a radius of curvature, at room temperature, having a sagitta of about 1 to about 25 microns, measured using a 5 inch spherometer.

20. In a method of planarizing a patterned semiconductor wafer by chemical-mechanical polishing with an apparatus containing a carrier assembly having a base plate, the improvement comprising utilizing a base plate having a convex surface portion with a radius of curvature, at room temperature, having a sagitta of about 1 to about 25 microns, measured using a 5 inch spherometer.

* * * * *